US011202155B2

(12) United States Patent
Rusconi Clerici Beltrami et al.

(10) Patent No.: US 11,202,155 B2
(45) Date of Patent: Dec. 14, 2021

(54) SOUND TRANSDUCER ARRANGEMENT

(71) Applicant: USOUND GMBH, Graz (AT)

(72) Inventors: Andrea Rusconi Clerici Beltrami, Vienna (AT); Ferruccio Bottoni, Graz (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 16/758,631

(22) PCT Filed: Oct. 12, 2018

(86) PCT No.: PCT/EP2018/077821
§ 371 (c)(1),
(2) Date: Apr. 23, 2020

(87) PCT Pub. No.: WO2019/081220
PCT Pub. Date: May 2, 2019

(65) Prior Publication Data

US 2020/0351595 A1 Nov. 5, 2020

(30) Foreign Application Priority Data

Oct. 26, 2017 (DE) ..... 10 2017 125 117.0

(51) Int. Cl.
*H04R 17/02* (2006.01)
*H04R 19/04* (2006.01)
*H04R 19/02* (2006.01)

(52) U.S. Cl.
CPC ..... *H04R 19/04* (2013.01); *H04R 19/02* (2013.01); *H04R 2201/003* (2013.01)

(58) Field of Classification Search
CPC ..... H04R 17/02; H04R 2217/00–03
USPC ..... 381/173, 190
See application file for complete search history.

(56) References Cited

U.S. PATENT DOCUMENTS

| | | | |
|---|---|---|---|
| 8,014,547 | B2 | 9/2011 | Ogura et al. |
| 10,349,182 | B2 | 7/2019 | Stoppel et al. |
| 10,425,741 | B2 | 9/2019 | Beltrami et al. |
| 10,433,063 | B2 | 10/2019 | Rusconi Clerici Beltrami et al. |
| 2011/0013300 | A1 | 1/2011 | Wu |
| 2011/0176695 | A1 | 7/2011 | Bai et al. |

(Continued)

FOREIGN PATENT DOCUMENTS

| | | | |
|---|---|---|---|
| CN | 101112119 | A | 1/2008 |
| CN | 105721996 | A | 6/2016 |
| CN | 205810862 | U | 12/2016 |

(Continued)

OTHER PUBLICATIONS

Chinese Examination Report dated Dec. 3, 2020, 9 pages.

(Continued)

*Primary Examiner* — Suhan Ni
(74) *Attorney, Agent, or Firm* — Dority & Manning, P.A.

(57) ABSTRACT

A MEMS sound transducer for generating and/or detecting sound waves in the audible wavelength spectrum includes a carrier: a diaphragm connected to and deflectable with respect thereto the carrier and a piezoelectric element spaced apart from the diaphragm along a reciprocation axis. The piezoelectric element includes a coupling element that extends along the reciprocation axis and connects to the diaphragm. The piezoelectric element and the coupling element form a cantilever. The MEMS sound transducer includes two cantilever arms are arranged one behind the other, in a top view.

11 Claims, 8 Drawing Sheets

(56) References Cited

U.S. PATENT DOCUMENTS

2020/0215574 A1 7/2020 Zadesky et al.

FOREIGN PATENT DOCUMENTS

| | | |
|---|---|---|
| DE | 102015116640 A1 | 4/2017 |
| JP | 2014160915 | 9/2014 |
| WO | WO 2001/089698 | 11/2001 |
| WO | WO 2016/034665 | 3/2016 |
| WO | WO 2017/055384 | 4/2017 |

OTHER PUBLICATIONS

German Search Report and English Translation thereof, German Application No. 10 2017 125 117.0, dated Aug. 29, 2018, 20 pages.
International Search Report and Written Opinion of the Searching Authority and English Translation thereof, PCT Application No. PCT/EP2018/077821, dated Dec. 5, 2018, 23 pages.

SOUND TRANSDUCER ARRANGEMENT

CROSS REFERENCE TO RELATED APPLICATIONS

This application is a continuation of copending International Application No. PCT/EP2018/077821, filed Oct. 12, 2018, which is hereby incorporated herein by this reference in its entirety for all purposes.

FIELD OF THE INVENTION

The present invention relates to a MEMS sound transducer, in particular for generating and/or detecting sound waves in the audible wavelength spectrum, comprising a carrier; a diaphragm, which is connected to the carrier and is deflectable with respect thereto along a reciprocation axis; at least one piezoelectric element for generating and/or detecting a deflection of the diaphragm, which is spaced apart from the diaphragm in the direction of the reciprocation axis and comprises a first end connected to the carrier and a second end deflectable in the direction of the reciprocation axis; and a coupling element, which extends in the direction of the reciprocation axis between the piezoelectric element and the diaphragm and connects the second end of the piezoelectric element to the diaphragm.

BACKGROUND OF THE INVENTION

WO 2016/034665 A1, which is related to U.S. Pat. No. 10,349,182, which is hereby incorporated herein by this reference for all purposes, describes a MEMS, which comprises a diaphragm, a reciprocating structure, which is coupled to the diaphragm, and at least two piezoelectric actuators, which are connected, via a plurality of connecting elements spaced apart from each other, to a plurality of contact points of the reciprocating structure spaced apart from each other, wherein the at least two piezoelectric actuators are designed for inducing a reciprocating motion of the reciprocating structure in order to deflect the diaphragm. A disadvantage of this MEMS, however, is that its performance is limited.

OBJECTS AND SUMMARY OF THE INVENTION

The object of the present invention is to improve the related art.

The object is achieved by means of a MEMS sound transducer having the features described below.

The invention relates to a MEMS sound transducer, which can be operated, for example, in order to generate and/or detect sound waves in the audible wavelength spectrum. The MEMS sound transducer can be arranged, for example, in a smartphone, in headphones, or in another electrical device. The MEMS sound transducer can also be operated, however, for generating and/or detecting ultrasonic waves. The MEMS sound transducer can then be arranged, for example, in medical and/or technical diagnostic devices, in distance sensors, or the like.

Furthermore, the MEMS sound transducer comprises a carrier and a diaphragm, which is connected to the carrier and is deflectable with respect thereto along a reciprocation axis. The diaphragm can be connected in its entire edge area to the carrier. With the aid of the diaphragm, on the one hand, sound waves can be generated. For this purpose, the diaphragm can be caused to vibrate, which also causes the air situated above the diaphragm to vibrate. The propagating vibrations are the sound waves, which transport a tone. On the other hand, the diaphragm can also be caused to vibrate, however. If sound waves impact the diaphragm, the diaphragm also begins to vibrate.

Moreover, the MEMS sound transducer comprises at least one piezoelectric element, which is spaced apart from the diaphragm in the direction of the reciprocation axis, for generating and/or detecting a deflection of the diaphragm. The piezoelectric element can be deflected with the aid of a voltage. If the piezoelectric element itself is deflected by a force acting upon the piezoelectric element, it generates a voltage. The piezoelectric element comprises a first end, which is connected to the carrier. In addition, the piezoelectric element comprises a second end, which is deflectable in the direction of the reciprocation axis.

In order to connect the second end of the piezoelectric element to the diaphragm, the MEMS sound transducer comprises a coupling element, which extends in the direction of the reciprocation axis between the piezoelectric element and the diaphragm. The deflection of the piezoelectric element generated by the voltage can be transmitted to the diaphragm with the aid of the coupling element in order to generate sound waves. With the aid of an electrical signal, the diaphragm can be set into corresponding vibrations via the coupling element, so that, for example, a tone can be generated. The vibrations of the sound waves can also be transmitted, with the aid of the coupling element, from the diaphragm to the piezoelectric element, which converts them into the electrical signal.

Furthermore, the at least one piezoelectric element and the coupling element, together, form a cantilever arm, which is clamped on one side and comprises a clamped end, formed by the first end of the piezoelectric element, and a free end formed by the coupling element. As a result, the cantilever arm can oscillate freely at the free end. Consequently, the piezoelectric element can undergo a high deflection along the reciprocation axis. For example, sound waves having a high amplitude can therefore be generated.

Furthermore, the MEMS loudspeaker has a high linearity. When the piezoelectric element is acted upon by the electrical signal, the free end deflects. Due to the fact that the piezoelectric element and the coupling element are designed as a cantilever arm, the deflection of the free end is linearly proportional to the instantaneous amplitude of the electrical signal. The sound waves generated as a result also have a sound amplitude, which is linearly proportional to the deflection of the free end. The sound waves generated from the electrical signal with the aid of the MEMS sound transducer according to the invention therefore have a high linearity.

Due to the design of the piezoelectric element and the coupling element as a cantilever arm, the diaphragm can also be acted upon by the piezoelectric element with the aid of great force. As a result, the diaphragm can be advantageously deflected or caused to vibrate.

Moreover, the MEMS sound transducer comprises multiple cantilever arms. As a result, the diaphragm can be deflected with the aid of a greater force.

According to the invention, at least two cantilever arms are arranged one behind the other, in a top view. As a result, the at least two cantilever arms can be arranged in a straight line, one behind the other. The at least two cantilever arms can be arranged with respect to one another in such a way that they extend on a common line. As a result, the MEMS sound transducer can be designed to be space-saving, since a width of the MEMS sound transducer can be kept small due to the arrangement of the cantilever arms one behind the other. In addition, as a result, the diaphragm can be deflected linearly, i.e., linearly with respect to the deflection of the two cantilever arms.

In one advantageous enhanced embodiment of the invention, the cantilever arm is connected, in the area of its free end, exclusively to the diaphragm. As a result, the free end can oscillate freely, without being affected by anything else with respect to the oscillation. The free end is not impeded or decelerated with respect to the oscillation, for example, by a further component. As a result, for example, the high linearity of the MEMS sound transducer is possible. In addition, as a result, a high deflection of the diaphragm can be achieved with the aid of a great force.

Furthermore, it is advantageous when an open region is formed, in a side view, between the side of the coupling element facing away from the actuator, and the carrier. As a result, a gap is formed so that the coupling element is spaced apart from the carrier and can oscillate freely.

It is also advantageous when the open region has a U-shape, in a top view, so that the cantilever arm is spaced apart from the carrier at its free end and at both of its longitudinal sides. As a result, only the clamped end of the cantilever arm has contact with the carrier, so that the longitudinal sides and the free end can oscillate freely with respect to the carrier.

It is advantageous when the carrier comprises at least one recess, in which the cantilever arm is arranged. The recess can be completely bordered by the carrier. Furthermore, the recess can extend completely through the carrier in the direction of the reciprocation axis, so that the recess has an upper opening and a lower opening. One of the two openings can be covered by the diaphragm.

When only one single cantilever arm is arranged in the recess, this is also advantageous. In this case, the cantilever arm can not be impeded by another cantilever arm with respect to the deflection along the reciprocation axis.

Additionally, it is advantageous when the MEMS sound transducer comprises multiple cantilever arms, which are arranged laterally adjacent to one another in a direction that is perpendicular to the reciprocation axis, in the top view. As a result, the force onto the diaphragm can be increased. In addition, with the aid of multiple cantilever arms spaced apart from one another, the diaphragm can be deflected uniformly and, in particular, in a planar manner. Consequently, the sound waves can be generated and/or detected in a planar manner. As a result, the cantilever arms can be arranged, for example, in a square, a rectangle, or another planar geometric figure or polygon. One cantilever arm can be arranged in one corner of the aforementioned figure or polygon in each case.

It is also advantageous when each of at least two cantilever arms are identically oriented with respect to one another. Additionally or alternatively, each of at least two cantilever arms can be oriented opposite to each other. As a result, the diaphragm can be advantageously deflected.

Moreover, it is advantageous when at least two adjacently arranged and identically oriented cantilever arms are connected to each other in the area of the free end with the aid of the coupling element. When the two cantilever arms are adjacently arranged to lie in a plane that extends in a direction perpendicular to the reciprocation axis of each adjacently arranged cantilever arm, their longitudinal sides face one another. Due to the connection of the two cantilever arms with the aid of the coupling element, the force of the two cantilever arms can be combined in the deflection.

It is advantageous when the coupling element is connected to the piezoelectric element with the aid of an articulated joint, so that the coupling element is rotatable in relation to the piezoelectric element. The articulated joint can be, for example, an elastic articulated joint or a flexible articulated joint. With the aid of the rotatability of the coupling element, the coupling element can remain aligned in parallel to the diaphragm during the deflection of the piezoelectric element. As a result, the diaphragm can be loaded to a lesser extent in a contact area between the coupling element and the diaphragm.

It is also advantageous when the piezoelectric element and the coupling element are formed as one piece from the same material. As a result, the piezoelectric element can be manufactured with the coupling element arranged thereon, for example, in one manufacturing step.

Moreover, it is advantageous when the MEMS sound transducer is a MEMS loudspeaker. Additionally or alternatively, the MEMS sound transducer can also be a MEMS microphone.

BRIEF DESCRIPTION OF THE DRAWINGS

Further advantages of the invention are described in the following exemplary embodiments. Wherein.

DETAILED DESCRIPTION OF EXEMPLARY EMBODIMENTS

Figure 1:
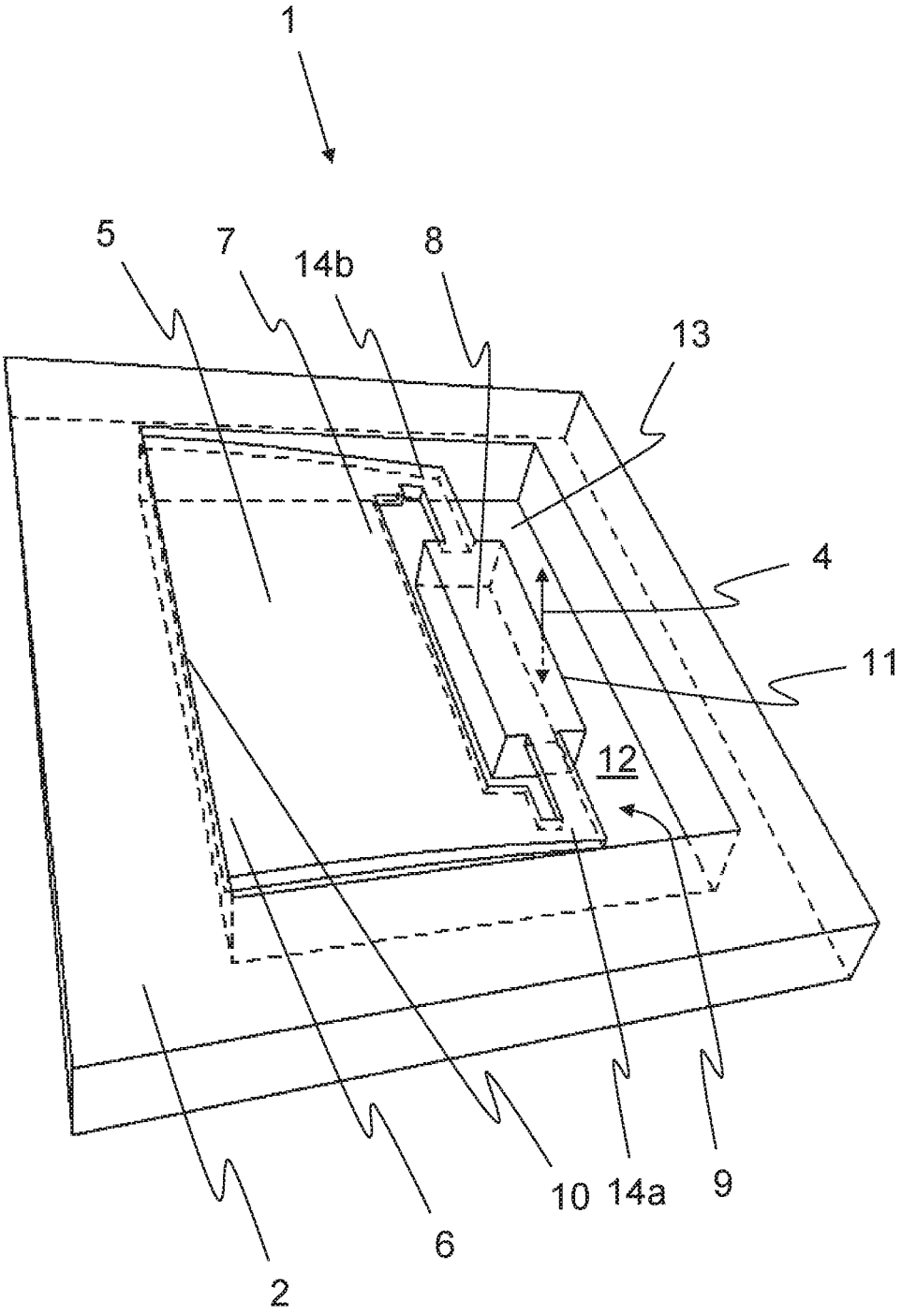
FIG. 1 shows a perspective view of a MEMS sound transducer comprising a carrier, a piezoelectric element, and a coupling element.

FIG. 1 shows a perspective view of a MEMS sound transducer 1. In order to explain the mode of operation, initially only one cantilever arm 9 is shown. With the aid of the MEMS sound transducer 1, for example, sound waves in the audible wavelength spectrum can be generated, so that this can be operated as a MEMS loudspeaker. Additionally or alternatively, with the aid of the MEMS sound transducer 1, sound waves in the audible wavelength spectrum can also be detected, so that this can be operated as a MEMS microphone. Furthermore, the MEMS sound transducer 1 can be arranged, for example, in a smartphone, in order to make it possible to make a telephone call or listen to music. The MEMS sound transducer 1 can also be arranged, for example, in headphones.

One further area of application of the MEMS sound transducer 1 can also be the generation and/or detection of ultrasonic waves, however. The MEMS sound transducer 1 can be arranged, for example, in an ultrasonic sensor, for example, a distance sensor.

Furthermore, the MEMS sound transducer 1 comprises a carrier 2, which can form a framework of the MEMS sound transducer 1. The carrier 2 can comprise, for example, a semiconductor substrate, which can be manufactured in an etching process. A diaphragm 3 (not shown here in FIG. 1), which is connected to the carrier 2, for example, fully circumferentially, can be arranged on the carrier 2. As shown in FIG. 2, FIG. 3, FIG. 4, FIG. 7 and FIG. 8 for example, the diaphragm 3 is deflectable along a reciprocation axis 4. With the aid of the deflection of the diaphragm 3, the air situated above the diaphragm 3 can be caused to vibrate, so that the sound waves are generated. However, the diaphragm 3 itself can also be caused to vibrate and, therefore, can be deflected, by the vibrating air. The diaphragm 3 can therefore detect the sound waves.

Figure 2:
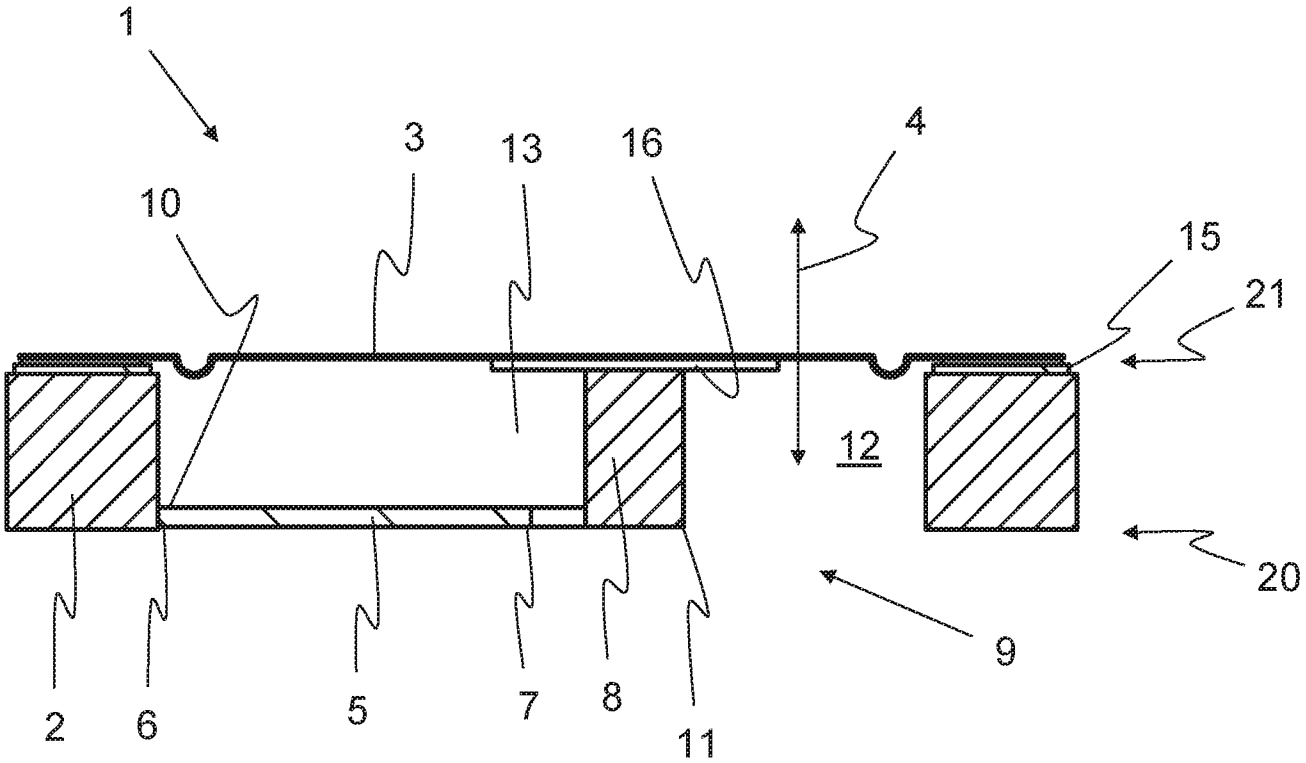
FIG. 2 shows a lateral sectional view of a MEMS sound transducer comprising a cantilever arm.

In order to detect and/or generate the deflection of the diaphragm 3, the MEMS sound transducer 1 comprises at least one piezoelectric element 5 spaced apart from the diaphragm 3 in the direction of the reciprocation axis 4 as shown in FIG. 2 for example. The piezoelectric element 5 can be deflected with the aid of an electrical signal, which encompasses, for example, music, wherein the deflection is transmitted onto the diaphragm 3, so that the sound waves are generated. The piezoelectric element 5 therefore acts as a piezoelectric actuator. The MEMS sound transducer 1 is operated as a MEMS loudspeaker in this case. If the piezoelectric element 5 is deflected by the diaphragm 3, however, then the piezoelectric element 5 generates an electrical signal, which corresponds to the sound waves picked up by the diaphragm 3. The piezoelectric element 5 therefore acts as a piezoelectric sensor. The MEMS sound transducer 1 is then operated as a MEMS microphone for example.

As shown in FIG. 2 for example, the piezoelectric element 5 also comprises a first end 6, which is connected to the carrier 2. Furthermore, the piezoelectric element 5 comprises a second end 7, which is deflectable in the direction of the reciprocation axis 4.

The MEMS sound transducer 1 also comprises a coupling element 8, which extends in the direction of the reciprocation axis 4 between the piezoelectric element 5 and the diaphragm 3 and connects the second end 7 of the piezoelectric element 5 to the diaphragm 3. The coupling element 8 therefore transmits the deflection of the piezoelectric element 5 onto the diaphragm 3 when the MEMS sound transducer 1 is operated as a loudspeaker. In addition, the coupling element 8 transmits the deflection of the diaphragm 3 onto the piezoelectric element 5 when the MEMS sound transducer 1 is operated as a microphone.

Preferably, as shown in FIG. 2 for example, the carrier 2 and the coupling element 8 can be formed from an identical material, such as a semiconductor material. Furthermore, the carrier 2 and the coupling element 8 can have an identical thickness in the direction of the reciprocation axis 4. For example, the carrier 2 and the coupling element 8 can be formed together in a layering method, wherein the hollow spaces around the carrier 2 and/or around the coupling element 8 are removed with the aid of etching processes. Additionally, the piezoelectric element 5 can also be formed together with the carrier 2 and/or the coupling element 8 with the aid of the layering method.

Moreover, the at least one piezoelectric element 5 and the coupling element 8, together, form a cantilever arm 9 clamped on one side. The cantilever arm 9 comprises a clamped end 10, formed by the first end 6 of the piezoelectric element 5, and a free end 11 formed by the coupling element 8. The piezoelectric element 5, together with the coupling element 8, can form a cantilever, which is connected to the carrier 2 at the clamped end 10. The free end 11 of the cantilever arm 9 can oscillate freely when it is connected exclusively to the diaphragm 3. In particular, the free end 11 has neither connection to the carrier 2 nor to any second piezoelectric element that is oppositely positioned beneath the piezoelectric element 5 depicted in FIG. 1. The free end 11 is decoupled with respect to the carrier 2. As a result, the free end 11 can oscillate freely. The free end 11 is not impeded with respect to the oscillation. As a result, the free end 11 can be deflected to a great extent, so that sound waves having a high amplitude can be generated and/or detected.

In addition, a high linearity is established as a result. The amplitude of the electrical signal can be converted into a linearly proportional amplitude of the sound waves. The same applies when the MEMS sound transducer 1 is operated as a microphone. In that case, the amplitude of the sound waves can be converted into a linearly proportional electrical signal. Furthermore, with the aid of the cantilever arm 9, the diaphragm 3 can be deflected with the aid of a great force, since the free end 11 can move unimpeded.

Figure 5:
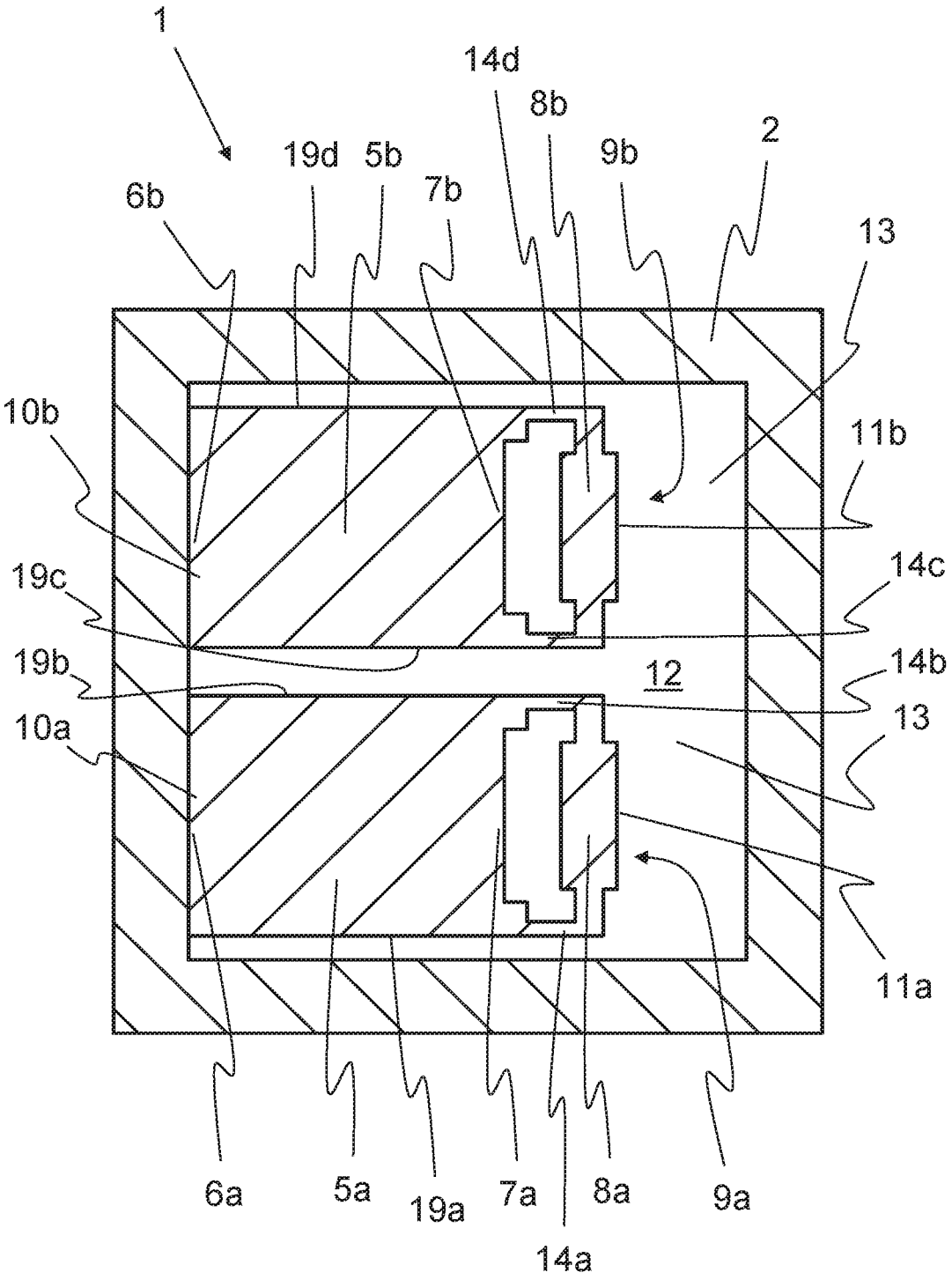
FIG. 5 shows a top view of a MEMS sound transducer comprising two cantilever arms.
Figure 6:
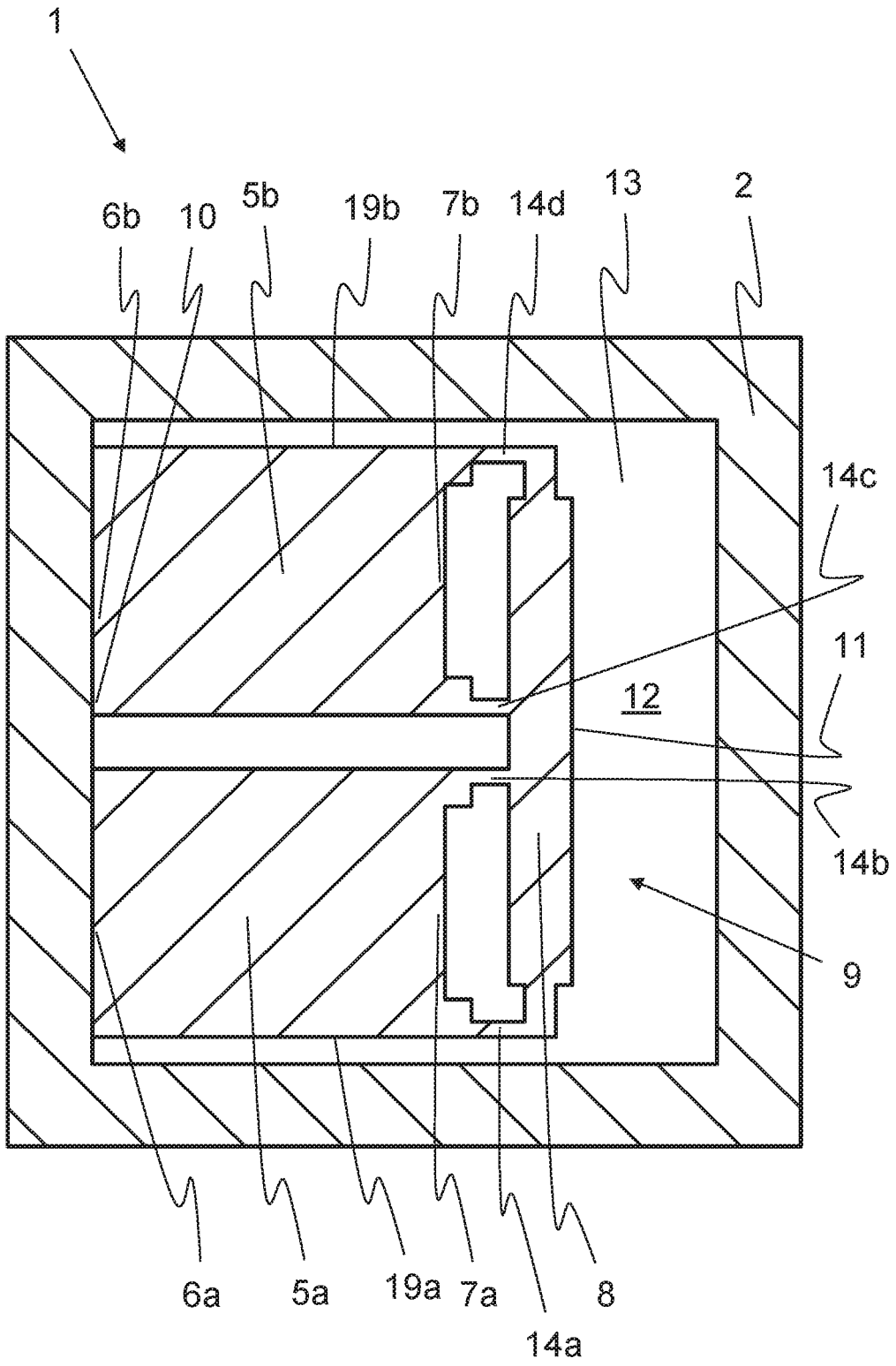
FIG. 6 shows a top view of a MEMS sound transducer comprising one cantilever arm.

Furthermore, as shown in FIG. 5 and FIG. 6 for example, the coupling element 8 can be arranged at the piezoelectric element 5 with the aid of an articulated joint 14*a*, 14*b*, which can be elastically formed. Additionally or alternatively, the articulated joint 14*a*, 14*b* can also be flexible. With the aid of the articulated joint 14*a*, 14*b*, during the deflection of the cantilever arm 9 along the reciprocation axis 4, the coupling element 8 can be rotated with respect to the piezoelectric element 5, so that the coupling element 8 can remain oriented in parallel to the diaphragm 3. The articulated joint 14*a*, 14*b* is preferably formed from at least one flexible and/or elastic connecting element. Preferably, the piezoelectric element 5 is formed from multiple layers, in particular at least one piezoelectric layer, one carrier layer, and/or one electrode layer. The at least one connecting element is preferably formed from one of these layers, in particular from the carrier layer.

Furthermore, according to the present exemplary embodiment from FIG. 1, the MEMS sound transducer 1 can comprise an open region 12 that defines a void between the side of the coupling element 8 facing away from the piezoelectric element 5, and the carrier 2. With the aid of the open region 12, the cantilever arm 9 can oscillate freely.

Moreover, as shown in FIG. 1 for example, the carrier 2 defines a recess 13, in which the cantilever arm 9 is arranged. In the present exemplary embodiment, the recess 13 is completely bordered by the carrier 2. Furthermore, the recess 13 extends completely through the carrier 2 in the direction of the reciprocation axis 4 and includes the open region 12.

In the description of the following exemplary embodiments, identical reference numerals are utilized for features that are identical or at least comparable in terms of their design and/or mode of operation as compared to the preceding exemplary embodiments. Provided these features are not explained in detail once again, their design and/or mode of operation correspond(s) to the design and mode of operation of the features already described above.

FIG. 2 shows a lateral sectional view of the MEMS sound transducer 1 as shown, for example, in FIG. 1. In this case, the diaphragm 3 is arranged on the carrier 2. In the present exemplary embodiment, the diaphragm 3 is arranged on a support element 15, which is connected to the carrier 2.

Furthermore, the diaphragm 3 can be clamped on the support element 15. As a result, the support element 15 can form a frame for the diaphragm 3.

Moreover, the diaphragm 3 can be arranged in the area of a top side 21 of the MEMS sound transducer 1. Furthermore, the MEMS sound transducer 1 comprises an underside 20 positioned opposite the top side 21 in the direction of the reciprocation axis. According to the present exemplary embodiment, the piezoelectric element 5 can be arranged in the region of the underside 20. Consequently, the coupling element 8 extends from the piezoelectric element 5 from the underside 20 to the diaphragm 3 at the top side 21.

According to the present exemplary embodiment, the MEMS sound transducer 1 comprises a coupling plate 16, which is arranged between the coupling element 8 and the diaphragm 3 and couples these to one another. The coupling plate 16 is arranged in the area of the top side 21 of the MEMS sound transducer 1. With the aid of the coupling plate 16, a planar force transmission between the coupling element 8 and the diaphragm 3 is established.

Figure 3:
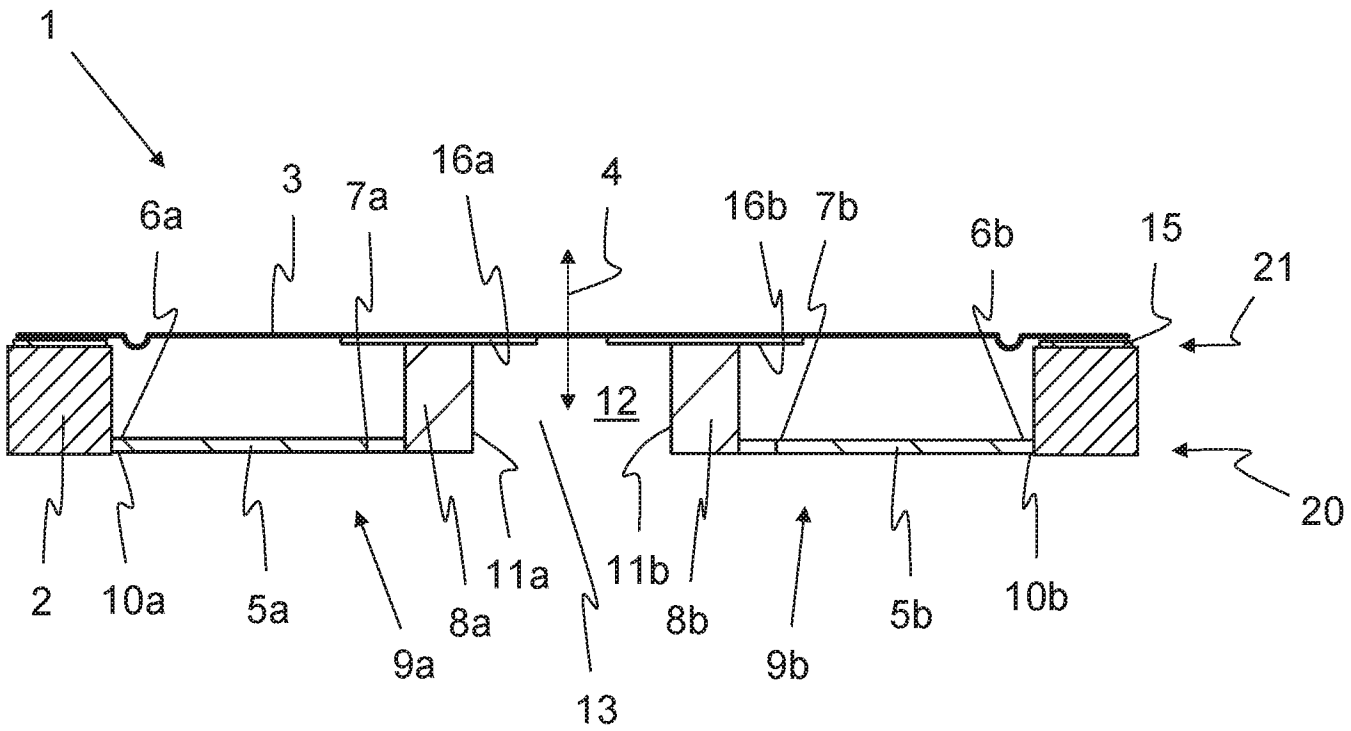
FIG. 3 shows a lateral sectional view of a MEMS sound transducer comprising two oppositely oriented cantilever arms.

FIG. 3 shows one further exemplary embodiment of a MEMS sound transducer 1 comprising two cantilever arms 9*a*, 9*b*. Each of the two cantilever arms 9*a*, 9*b* comprises a coupling element 8*a*, 8*b*, respectively, and a piezoelectric element 5*a*, 5*b*, respectively. The open region 12 is arranged between the two coupling elements 8*a*, 8*b*. The two cantilever arms 9*a*, 9*b* are not directly coupled to one another. The two cantilever arms 9*a*, 9*b* are connected only to the diaphragm 3. According to the present exemplary embodiment, assigned to each coupling element 8*a*, 8*b* is a coupling plate 16*a*, 16*b*, respectively, which connects the coupling element 8*a*, 8*b*, respectively, to the diaphragm 3.

Furthermore, the two cantilever arms 9*a*, 9*b* are oriented opposite to each other in the sense that the two free ends 11*a*, 11*b* of the two cantilever arms 9*a*, 9*b*, respectively, face toward one another. The two cantilever arms 9*a*, 9*b* are connected to one another only via the diaphragm 3. The two cantilever arms 9*a*, 9*b* are arranged offset from the other in this case. "Arranged offset from the other" can mean, in this case, that the at least two cantilever arms 9*a*, 9*b* are merely offset with respect to one another in a translatory manner in a transverse direction of the MEMS sound transducer 1 as shown in FIG. 3, FIG. 4, FIG. 5, FIG. 6, FIG. 7 and FIG. 8 for example. The at least two cantilever arms 9*a*, 9*b* can be arranged, for example, on a line.

The MEMS sound transducer 1 of the exemplary embodiment from the present FIG. 3 comprises the recess 13 in which both cantilever arms 9*a*, 9*b* are arranged.

Figure 4:
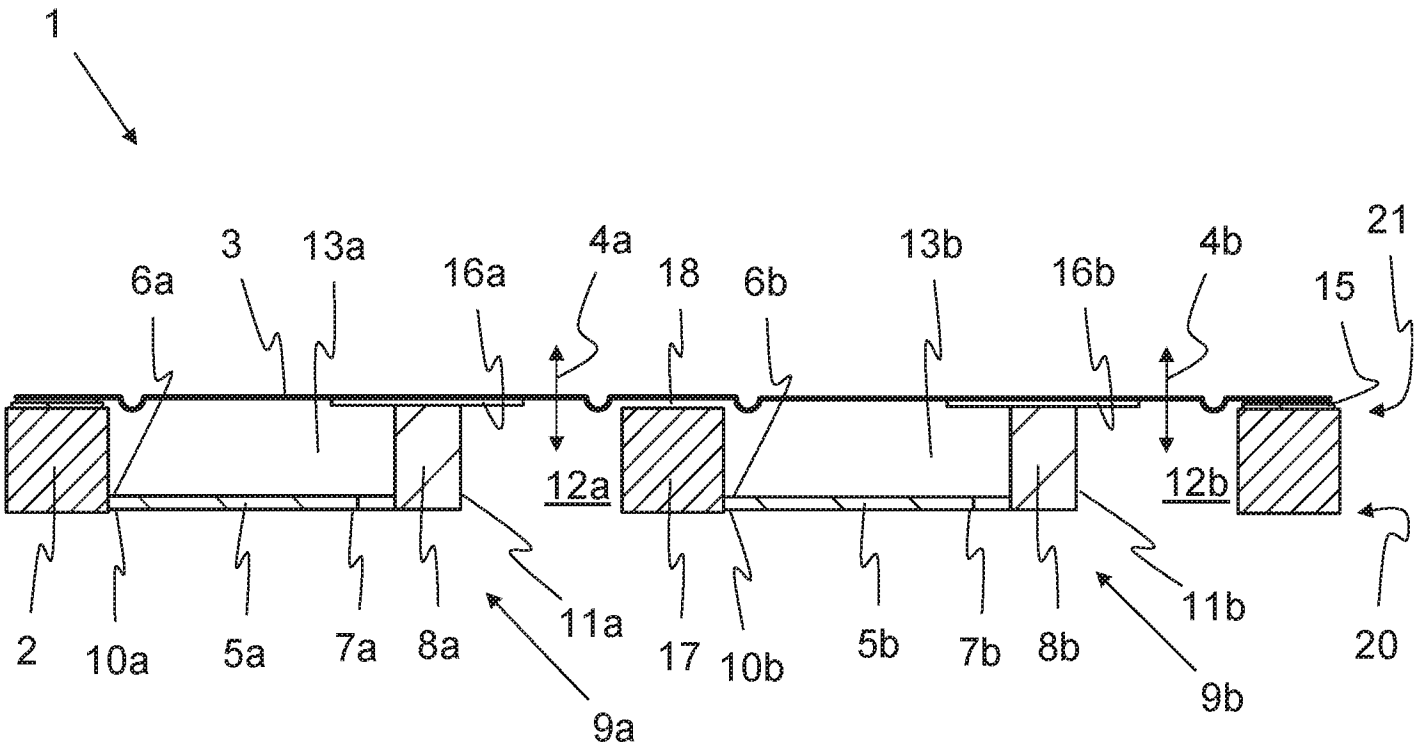
FIG. 4 shows a lateral sectional view of a MEMS sound transducer comprising two identically oriented cantilever arms.

FIG. 4 shows one further exemplary embodiment of a MEMS sound transducer 1 comprising two identically oriented cantilever arms 9*a*, 9*b*. In this case, identically oriented means that the respective coupling elements 8*a*, 8*b* are both facing toward the carrier 17, 2. The MEMS sound transducer 1 can comprise two recesses 13*a*, 13*b*, wherein one cantilever arm 9*a*, 9*b* is arranged in one recess 13*a*, 13*b*, respectively. The two recesses 13*a*, 13*b* are separated from one another by a middle piece 17 of the carrier 2. The second cantilever arm 9*b* is arranged at the middle piece 17. The first cantilever arm 9*a* and the second cantilever arm 9*b* are aligned identically with respect to one another and/or are oriented identically with respect to one another. However, the first cantilever arm 9*a* and the second cantilever arm 9*b* are offset with respect to one another in a translatory manner in the transverse direction of the MEMS sound transducer 1. The two cantilever arms 9*a*, 9*b* are arranged offset from the other in this case. "Arranged offset from the other" can mean, in this case, that the at least two cantilever arms 9*a*, 9*b* are merely offset with respect to one another in a translatory manner in a transverse direction, which is perpendicular to the reciprocation axis 4, of the MEMS sound transducer 1. The at least two cantilever arms 9*a*, 9*b* can be arranged, for example, on a line. Therefore, they have the same freedom of movement with respect to one another, but engage the diaphragm 3 in different areas, which are offset with respect to one another in a translatory manner.

Figure 7:
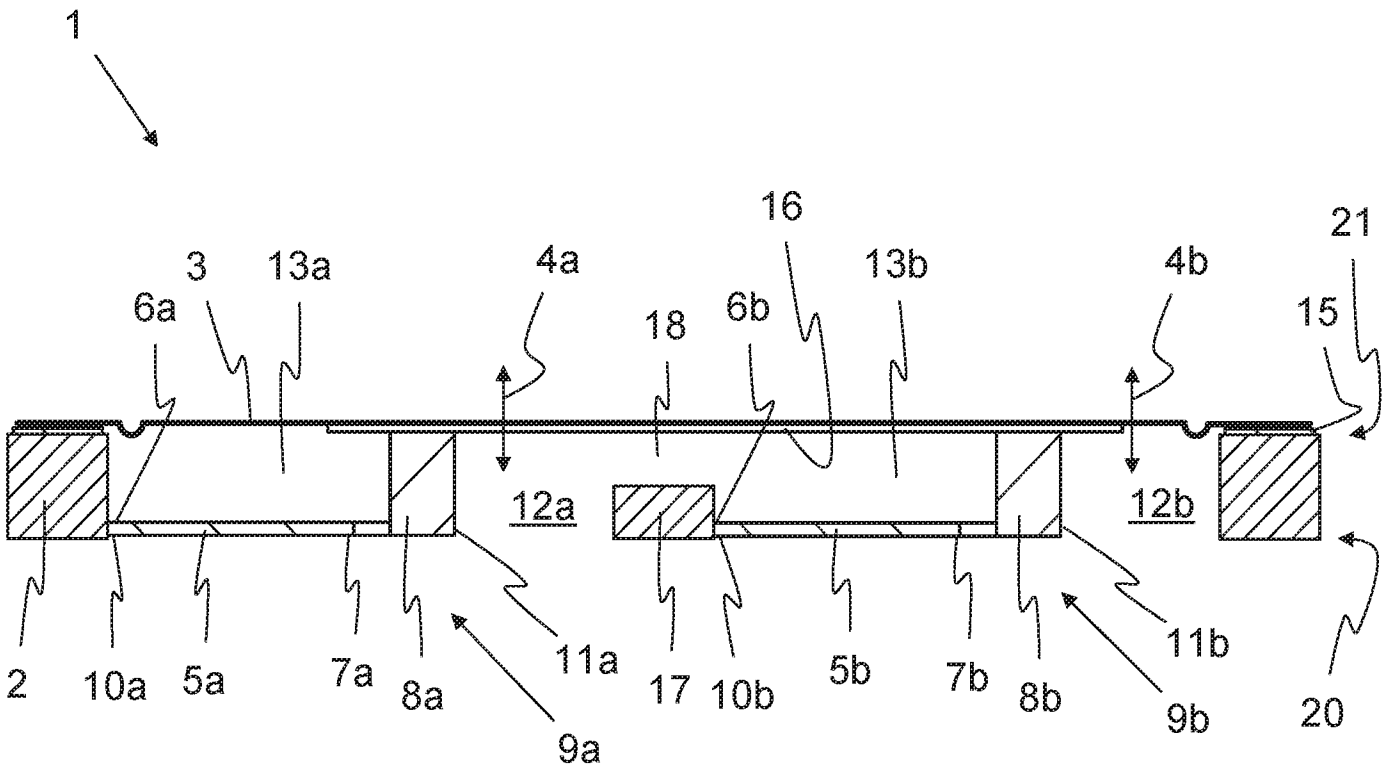
FIG. 7 shows a lateral sectional view of a MEMS sound transducer comprising two cantilever arms and one coupling plate.

The diaphragm 3 extends beyond the middle piece 17. According to the present exemplary embodiment from FIG. 4, a gap 18 is formed between the middle piece 17 of the carrier 2 and the diaphragm 3 in the neutral position of the diaphragm 3. The diaphragm 3 is therefore spaced apart from the middle piece 17 of the carrier 2. Consequently, the diaphragm 3 is decoupled from the middle piece 17. In the present case, the carrier 2 is designed to be precisely as thick in the area of the middle piece 17 as in its edge area. Alternatively, as shown in FIG. 7, the middle piece 17 could also be designed to be thinner than the edge area, so that the gap 18 or the distance between the diaphragm 3 and the middle piece 17 is enlarged. Alternatively, the diaphragm 3, in its neutral position, could also rest loosely on the middle piece 17. In another alternative exemplary embodiment, the diaphragm 3 can also be connected, in particular adhered, to the middle piece 17 of the carrier 2.

With the aid of the two cantilever arms 9*a*, 9*b*, the diaphragm 3 can be deflected to an even greater extent. In addition, the diaphragm 3 can be deflected with the aid of a greater force and uniformly in a planar manner.

FIG. 5 shows one further exemplary embodiment of a MEMS sound transducer 1, in a top view along the direction of the reciprocation axis, comprising two cantilever arms 9*a*, 9*b*. The two cantilever arms 9*a*, 9*b* are adjacently arranged and identically oriented in the sense that both are connected to a common part of the carrier 2. Moreover, the two cantilever arms 9*a*, 9*b* comprise longitudinal sides 19*a*-19*d*, which are parallel to one another. The first longitudinal side 19*a* of the first cantilever arm 9*a* as well as the second longitudinal side 19*d* of the second cantilever arm 9*b* face the carrier 2 and are spaced apart from the carrier 2. The second longitudinal side 19*b* of the first cantilever arm 9*a* and the first longitudinal side 19*c* of the second cantilever arm 9*b* face one another and are spaced apart from one another. The open region 12 is therefore arranged around the particular cantilever arm 9*a*, 9*b* in a U-shaped manner. The open region 12 therefore has, in this top view from FIG. 5, a U-shape around a particular cantilever arm 9*a*, 9*b*. The open region 12 around both cantilever arms 9*a*, 9*b* has a W-shape.

The two cantilever arms 9*a*, 9*b* have no direct connection to one another. The two cantilever arms 9*a*, 9*b* thus are decoupled from one another. The respective free ends 11*a*, 11*b* of the two cantilever arms 9*a*, 9*b* are both connected only to the diaphragm 3.

With the aid of the arrangement of the cantilever arms 9*a*, 9*b* adjacent to one another and the arrangement one behind the other, the multiple cantilever arms 9*a*, 9*b* can be arranged in a planar manner. At least three cantilever arms 9 are necessary for this purpose. For example, two cantilever arms 9*a*, 9*b* can be arranged according to the exemplary embodiment shown here in FIG. 5 and at least one further cantilever arm can be arranged alongside one of the two cantilever arms 9*a*, 9*b*. Nonetheless, at least two cantilever arms 9 are arranged alongside each other. The three cantilever arms 9 can then be arranged in the geometric figure of a right triangle, wherein one cantilever arm 9 is in a corner of the right triangle in each case. As a result, the diaphragm 3 can be deflected in a planar manner. In a further alternative embodiment, the three cantilever arms 9 can also be arranged in an isosceles or equilateral triangle.

Alternatively, cantilever arms can also be arranged in another geometric figure, wherein the number of corners of the geometric figure corresponds to the number of cantilever arms. For example, four cantilever arms can be arranged in a square, a rectangle, a trapezoid, a rhombus, or an irregular quadrilateral.

FIG. 6 shows one further exemplary embodiment of a MEMS sound transducer 1 comprising a cantilever arm 9, which includes two piezoelectric elements 5*a*, 5*b* and one common coupling element 8. The two piezoelectric elements 5*a*, 5*b* are adjacently arranged and oriented identically to one another. In the region of its two ends 7*a*, 7*b*, the two piezoelectric elements 5*a*, 5*b* are connected to one another with the aid of a common coupling element 8. As a result, the diaphragm 3 can be deflected with the aid of a great force.

The first longitudinal side 19*a* and the second longitudinal side 19*b* of the cantilever arm 9 shown in FIG. 6 are each spaced apart from the carrier 2. The open region 12 is designed to be U-shaped in this case and extends around the cantilever arm 9. As a result, the free end 11 of the cantilever arm 9 can deflect freely along the reciprocation axis 4 (not shown in FIG. 6), which is normal to the view in FIG. 6.

FIG. 7 shows one further exemplary embodiment of a MEMS sound transducer 1, which comprises two cantilever arms 9*a*, 9*b*. The two cantilever arms 9*a*, 9*b* are oriented identically with respect to one another, wherein the second cantilever arm 9*b* is arranged at the middle piece 17 of the carrier 2. In the present exemplary embodiment of FIG. 7, the two coupling elements 8*a*, 8*b* of the two cantilever arms 9*a*, 9*b*, respectively, are connected to the diaphragm 3 with the aid of the same, in particular single, coupling plate 16. As a result, the diaphragm 3 can be synchronously deflected by both cantilever arms 9*a*, 9*b*. The coupling plate 16 extends in the transverse direction of the MEMS sound transducer 1 over the first coupling element 8*a* as well as over the second coupling element 8*b*.

The gap 18, according to the present exemplary embodiment of FIG. 7, is greater than the gap 18 from FIG. 4. For this purpose, the middle piece 17 is designed to be thinner than the edge area of the carrier 2. The gap 18 is preferably approximately one half of a thickness of the edge area of the carrier 2 in the direction of the reciprocation axis 4. As a result, the diaphragm 3 can deflect to a great extent in the direction of the middle piece 17, without impacting the middle piece 17. Alternatively, however, the middle piece 17 can also extend up to the coupling plate 16, so that the coupling plate 16 rests loosely on the middle piece 17 in the neutral position of the diaphragm 3. The middle piece 17 can therefore also be precisely as thick as the edge area of the carrier 2. The rigid coupling plate 16 extending over the middle piece 17 is decoupled from the middle piece 17, however, in particular being spaced apart therefrom in the neutral position of the diaphragm 3.

Additionally, the two cantilever arms 9*a*, 9*b* can also comprise the articulated joint 14*a-d* (not shown here) or connecting elements. As a result, the coupling elements 8*a*, 8*b* of the cantilever arms 9*a*, 9*b*, respectively, can rotate with respect to the corresponding piezoelectric elements 5*a*, 5*b*, so that, during the deflection of the diaphragm 3, the coupling elements 8*a*, 8*b* remain aligned in parallel to the diaphragm 3.

The cantilever arms 9*a*, 9*b* are arranged one behind the other in this case. The at least two cantilever arms 9*a*, 9*b* can therefore be arranged on a line. In one alternative exemplary embodiment, multiple, for example, three, four, cantilever arms 9 can also be arranged one behind the other, in particular on a line. Additionally, at least one cantilever arm 9 can also be arranged adjacent to at least one of the cantilever arms 9*a*, 9*b* shown here. Two adjacently arranged cantilever arms 9*a*, 9*b* are shown, for example, in FIG. 5.

Figure 8:
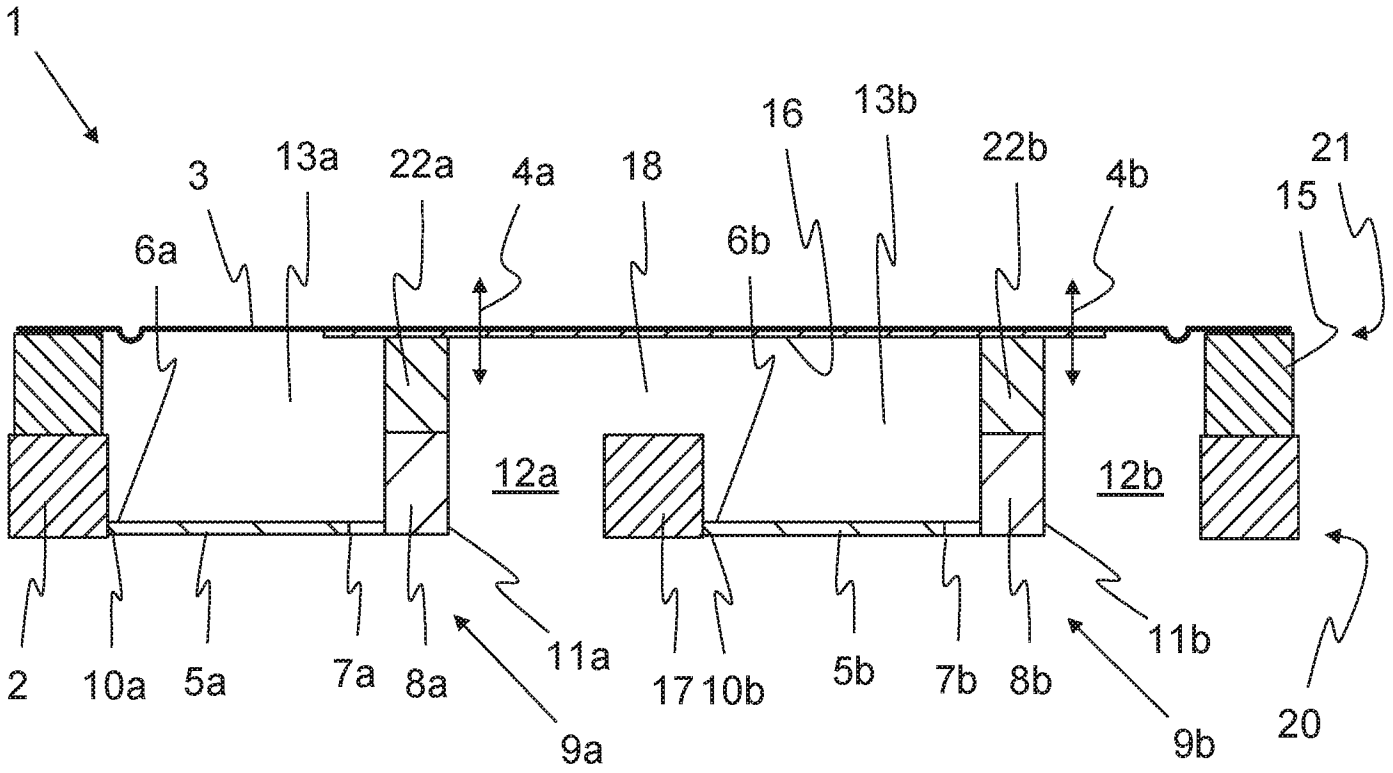
FIG. 8 shows a lateral sectional view of a MEMS sound transducer comprising a spacer element between the diaphragm and the coupling elements.

FIG. 8 shows one further exemplary embodiment of a MEMS sound transducer 1. A spacer element 22*a*, 22*b* is arranged between the diaphragm 3 and the two coupling elements 8*a*, 8*b*, respectively, of this exemplary embodiment. The spacer elements 22*a*, 22*b* can have, in the direction of the reciprocation axis 4, a thickness comparable to the carrier 2 and/or to the support element 15. In particular, a sum of the thicknesses of the spacer elements 22*a*, 22*b* and a thickness of the coupling plate 16 can correspond to the thickness of the support element 15. The spacer elements 22*a*, 22*b* can be adhesively bonded onto the coupling elements 8*a*, 8*b*, respectively, for example, after a process of manufacturing the coupling elements 8*a*, 8*b*. Due to the spacer elements 22*a*, 22*b*, for example, the volumes of the open areas 12*a*, 12*b* and of the recesses 13*a*, 13*b* can be enlarged. As a result, acoustic properties of the MEMS sound transducer 1 can be adjusted.

Furthermore, according to FIG. 8, the gap 18 is arranged between the middle piece 17 and the diaphragm 3 and is widened due to the fact that the spacer elements 22*a*, 22*b* are arranged between the diaphragm 3 and the coupling elements 8*a*, 8*b*, respectively.

In this case as well, multiple cantilever arms 9*a*, 9*b* can once again be arranged adjacent one another, as shown, for example, in FIG. 5 and as described with respect thereto. The two cantilever arms 9*a*, 9*b* shown here are arranged one behind the other again. Multiple cantilever arms 9*a*, 9*b* can also be arranged one behind the other, however.

The present invention is not limited to the represented and described exemplary embodiments. Modifications within the scope of the claims are also possible, as is any combination of the features, even if they are represented and described in different exemplary embodiments.

LIST OF REFERENCE NUMERALS

1 MEMS sound transducer
2 carrier
3 diaphragm
4 reciprocation axis
5 piezoelectric element
6 first end
7 second end
8 coupling element
9 cantilever arm
10 clamped end
11 free end
12 open region
13 recess
14 articulated joint
15 support element
16 coupling plate
17 middle piece
18 gap
19 longitudinal side
20 underside
21 top side
22 spacer element

The invention claimed is:

1. A MEMS sound transducer for generating and/or detecting sound waves in the audible wavelength spectrum, the MEMS sound transducer comprising:

a carrier;

a diaphragm connected to the carrier and deflectable with respect thereto along a reciprocation axis;

a piezoelectric element configured for generating and/or detecting a deflection of the diaphragm, the piezoelectric element is spaced apart from the diaphragm in the direction of the reciprocation axis, the piezoelectric element defines a first end connected to the carrier and a second end deflectable in the direction of the reciprocation axis; and a coupling element, which extends in the direction of the reciprocation axis between the piezoelectric element and the diaphragm and connects the second end of the piezoelectric element to the diaphragm;

wherein the coupling element defines a side, which faces away from the piezoelectric element and is spaced apart from the carrier and defines a void between the side and the carrier;

wherein the piezoelectric element and the coupling element form a first cantilever arm that defines a clamped end formed by the first end of the piezoelectric element and a free end formed by the coupling element;

wherein the first cantilever arm defines a pair of longitudinal sides extending from the free end to the clamped end, and wherein the void has a U-shape, in a top view taken along the reciprocation axis, so that the free end of the first cantilever arm is spaced apart from the carrier and each of the longitudinal sides is spaced apart from the carrier; and wherein the MEMS sound transducer includes a second cantilever arm, and the two cantilever arms are arranged one behind the other in a view taken in a direction that is perpendicular to the reciprocation axis.

2. The MEMS sound transducer as in claim 1, wherein the free end of the first cantilever arm is connected exclusively to the diaphragm.

3. The MEMS sound transducer as claimed in claim 1, wherein the carrier defines a recess in which the second cantilever arm is arranged, wherein the recess is completely bordered by the carrier.

4. The MEMS sound transducer as claimed in claim 3, wherein a single cantilever arm is arranged in the recess.

5. The MEMS sound transducer as claimed in claim 1, further comprising a third cantilever arm disposed between the first and second cantilever arms such that in the top view, the three cantilever arms are arranged laterally adjacent to one another.

6. The MEMS sound transducer as claimed in claim 5, wherein at least two cantilever arms are oriented oppositely with respect to one another.

7. The MEMS sound transducer as claimed in claim 1, wherein the coupling element is connected to the piezoelectric element with the aid of an elastic or flexible, articulated joint, so that the coupling element is rotatable in relation to the piezoelectric element.

8. The MEMS sound transducer as claimed in claim 1, wherein the MEMS sound transducer is a MEMS loudspeaker and/or a MEMS microphone.

9. A MEMS sound transducer for generating and/or detecting sound waves in the audible wavelength spectrum, the MEMS sound transducer comprising:

a carrier;

a diaphragm connected to the carrier and deflectable with respect thereto along a reciprocation axis;

a first piezoelectric element configured for generating and/or detecting a deflection of the diaphragm, the first piezoelectric element is spaced apart from the diaphragm in the direction of the reciprocation axis, the first piezoelectric element defines a first end connected to the carrier and a second end deflectable in the direction of the reciprocation axis; and a coupling element, which extends in the direction of the reciprocation axis between the first piezoelectric element and the diaphragm and connects the second end of the first piezoelectric element to the diaphragm;

wherein the first piezoelectric element and the coupling element form a first cantilever arm that defines a clamped end formed b the first end of the first piezoelectric element and a free end formed by the coupling element;

wherein the MEMS sound transducer includes a second cantilever arm defining a clamped end spaced apart from a deflectable end, the clamped end of the second cantilever arm being disposed closer to the second end of the first piezoelectric element of the first cantilever arm than is the deflectable end of the second cantilever arm so that the two cantilever arms are arranged one behind the other in a view taken in a direction that is perpendicular to the reciprocation axis and parallel to the plane of the diaphragm when the diaphragm is not being deflected; and wherein the first cantilever arm is oriented identically with respect to the second cantilever arm.

10. The MEMS sound transducer as claimed in claim 9, wherein the identically oriented cantilever arms are connected to each other in the area of the free end with the aid of the coupling element.

11. A MEMS sound transducer for generating and/or detecting sound waves in the audible wavelength spectrum, the MEMS sound transducer comprising:

a carrier;

a diaphragm connected to the carrier and deflectable with respect thereto along a reciprocation axis;

a piezoelectric element configured for generating and/or detecting a deflection of the diaphragm, the piezoelectric element is spaced apart from the diaphragm in the direction of the reciprocation axis, the piezoelectric element defines a first end connected to the carrier and a second end deflectable in the direction of the reciprocation axis; and a coupling element, which extends in the direction of the reciprocation axis between the piezoelectric element and the diaphragm and connects the second end of the piezoelectric element to the diaphragm;

wherein the piezoelectric element and the coupling element form a first cantilever arm that defines a clamped end formed by the first end of the piezoelectric element and a free end formed by the coupling element;

wherein the MEMS sound transducer includes a second cantilever arm, and the two cantilever arms are arranged one behind the other in a view taken in a direction that is perpendicular to the reciprocation axis; and wherein the piezoelectric element and the coupling element are formed from the same material.

* * * * *